United States Patent [19]

Mayne

[11] 3,955,751

[45] *May 11, 1976

[54] MAILING DEVICE

[76] Inventor: David R. Mayne, 6719 Waverly, Indianapolis, Ind. 46220

[ * ] Notice: The portion of the term of this patent subsequent to Oct. 22, 1991, has been disclaimed.

[22] Filed: Oct. 21, 1974

[21] Appl. No.: 516,677

Related U.S. Application Data

[63] Continuation-in-part of Ser. No. 233,270, March 9, 1972, Pat. No. 3,843,042.

[52] U.S. Cl. ..... 229/73

[51] Int. Cl.[2] ..... B65D 27/06

[58] Field of Search ..... 229/73, 69; 282/11.5 A, 282/11.5 R, 22 R, 25

[56] References Cited

UNITED STATES PATENTS

| | | | |
|---|---|---|---|
| 3,250,456 | 5/1966 | Schuessler | 229/73 X |
| 3,843,042 | 10/1974 | Mayne | 229/73 |

*Primary Examiner*—William Price
*Assistant Examiner*—Stephen P. Garbe
*Attorney, Agent, or Firm*—Woodard, Weikart, Emhardt & Naughton

[57] ABSTRACT

A mailing and return device. A multiple sheet form having a sender section and a receiver section along with an area for writing messages is folded and fits within a mailing envelope which has a pair of windows in registry with the sender section and the receiver section. Each sheet has a top stub portion joined thereto along a tearable line. One of the sheets may be retained by the sender and another sheet by the receiver. A return envelope is included within the mailing envelope to allow the receiver to write a message on the form and then remove the top sheet and return it to the sender within the return envelope. The return envelope is provided with a window in registry with the sender section. The lengths of the sheets are provided in such a way so as to automatically place the sections in registry with the appropriate windows or window.

12 Claims, 10 Drawing Figures

MAILING DEVICE

REFERENCE TO CO-PENDING APPLICATION

This application is a continuation-in-part of my co-pending application, Ser. No. 233,270, filed Mar. 9, 1972 now U.S. Pat. No. 3,843,042.

BACKGROUND OF THE INVENTION

1. Field of the Invention

This invention is in the field of mailing devices.

2. Description of the Prior Art

A representative sample of the prior art is disclosed in the following U.S. Pat. Nos.

1,708,574 issued to L. P. Hazen;

3,073,509 issued to L. R. Schuessler;

3,250,456 issued to L. R. Schuessler; and 3,288,351 issued to S. J. Benz, Jr.

Many of the prior art mailing devices are designed for a specific type of business such as banks. The mailing device disclosed herein has been designed so as to be utilized for basic business transactions regardless of the type of business involved. The mailing device disclosed herein is distinguishable from the prior art devices in that the lengths of the sheets of the device determines the positioning of the names and addresses of the sender and receiver with respect to the windows of the original mailing envelope and the return envelope.

SUMMARY OF THE INVENTION

One embodiment of the present invention is a mailing device comprising a first and second parallel paper sheet each having a top stub portion attached together, the first sheet having a sender section and a receiver section, the second sheet being removable therefrom, said first and second sheet being folded thereby defining a fold and positioning the second sheet inward of the first sheet and the sender section and the receiver section on the same side of the fold, a return envelope positioned inward of the first and second folded sheets, the envelope having a first window in registry with the sender section when the stub portion of the first sheet is removed therefrom and the first sheet is removed from the second sheet and folded along said fold and inserted in the envelope, and a sending envelope containing the first and second sheet in the folded condition and the return envelope positioned inwardly of the first sheet, the sending envelope having a second window in registry respectively with the receiver section, said first sheet having a top edge spaced a fixed distance from said first fold, said sending envelope having an interior length not less than said distance and approximately equal thereto preventing excessive lengthwise shift of said first sheet and movement of said receiver section with respect to said second window.

It is an object of the present invention to provide a new and improved mailing and return device.

It is the further object of the present invention to provide a mailing and return device which has sheets of critical length determining the registration of the name and address of the addressee and addresser with respect to the envelope windows.

Related objects and advantages of the present invention will be apparent from the following description.

DESCRIPTION OF THE PREFERRED EMBODIMENTS

Figure 1:
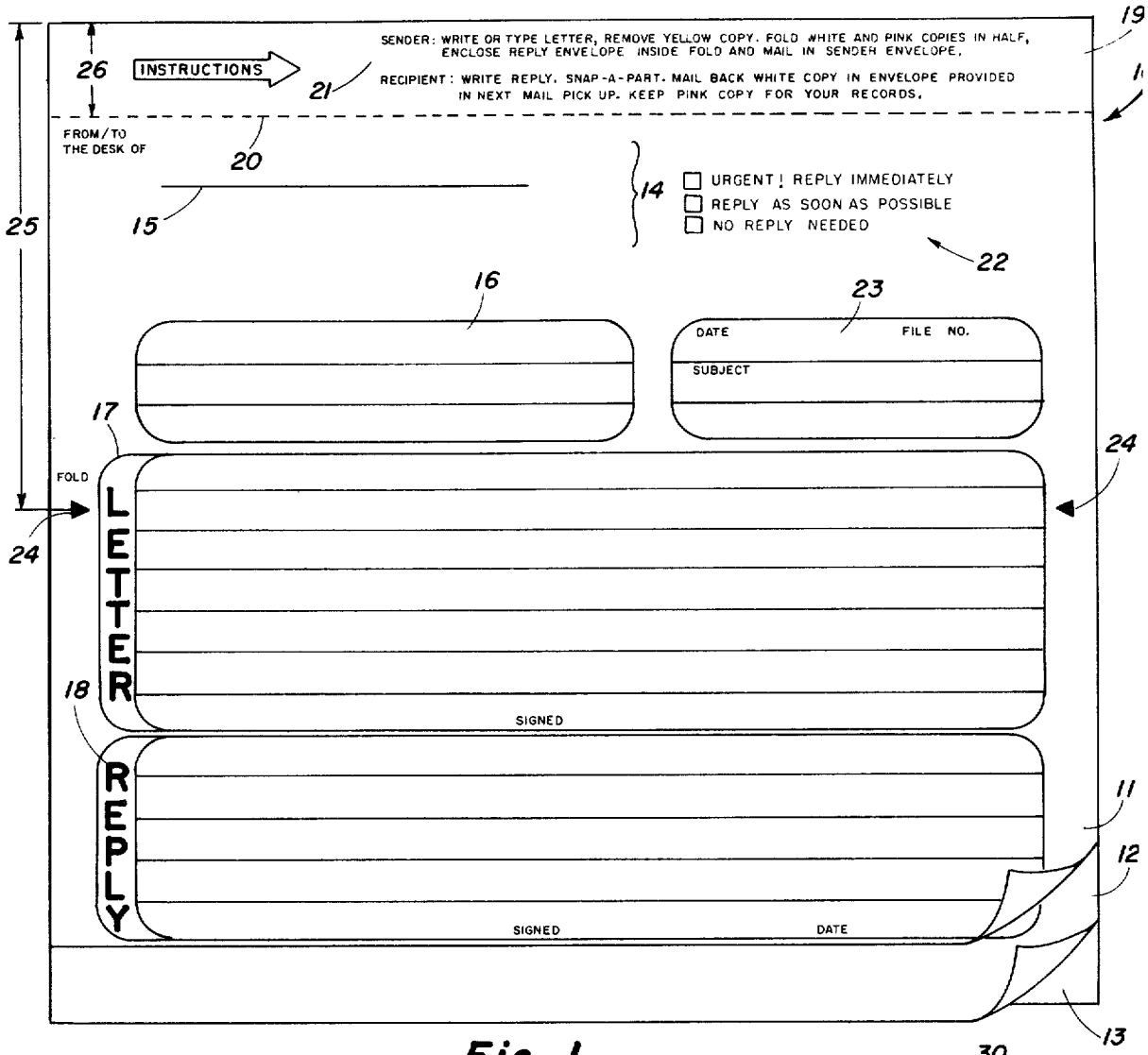
FIG. 1 is a plan view of one embodiment of a mailing and return form utilized with the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications on the principles of the invention as illustrated therein being contemplated as would normally occur to one skilled in the art to which the invention relates.

Referring now more particularly to FIG. 1, there is shown a mailing and return form 10 having a top sheet 11, a middle sheet 12 and a bottom sheet 13 connected together at the top portion of each sheet. The printed matter on sheet 11 is identical with the printed matter on sheets 12 and 13 and thus, the following description of the printed matter of sheet 11 will apply equally to sheets 12 and 13. Area 14 is reserved for placing the name and address of the sender. Area 16 is reserved for the placing of the name and address of the receiver. The letter or message placed on the sheet by the sender is positioned in area 17 whereas the reply or message of the receiver is placed in area 18.

Each sheet has a top stub portion 19. The top stub portion may be removed from each sheet by simply tearing along a perforated line 20. Various instructions 21 are located on the stub 19 of the top sheet. In addition, additional printed instructions 22 are positioned near perforated line 20 of each sheet. The date and subject may be placed in area 23 of each sheet. As shown in the lower right hand corner of FIG. 1, each sheet has a different length. In addition, each sheet may be of a different color. The length of the sheets are critical to the operation and success of the invention. It is desired to have means whereby the written information placed on sheet 11 will automatically be transferred to sheets 12 and 13. This can be accomplished by either placing carbon paper between sheets 11 and 12, and 12 and 13 or producing sheets 12 and 13 from carbonless imaging paper. Such paper is disclosed in the U.S. Pat. No. 3,516,846 issued to Gale W. Matson and the disclosure contained therein relating to said paper is hereby incorporated by reference. Another similar paper is disclosed in the U.S. Pat. No. 2,730,457 issued to Barrett K. Green and Lowell Schleicher which is also hereby incorporated by reference. By utilizing carbonless imaging paper, the marks or writing on the imaging paper will appear as a result of pressure applied to the paper by any type of element. Thus, by writing with a pencil on sheet 11, the writing will automatically be transferred to sheets 12 and 13 if sheets 12 and 13 are carbonless imaging paper.

Figure 2:
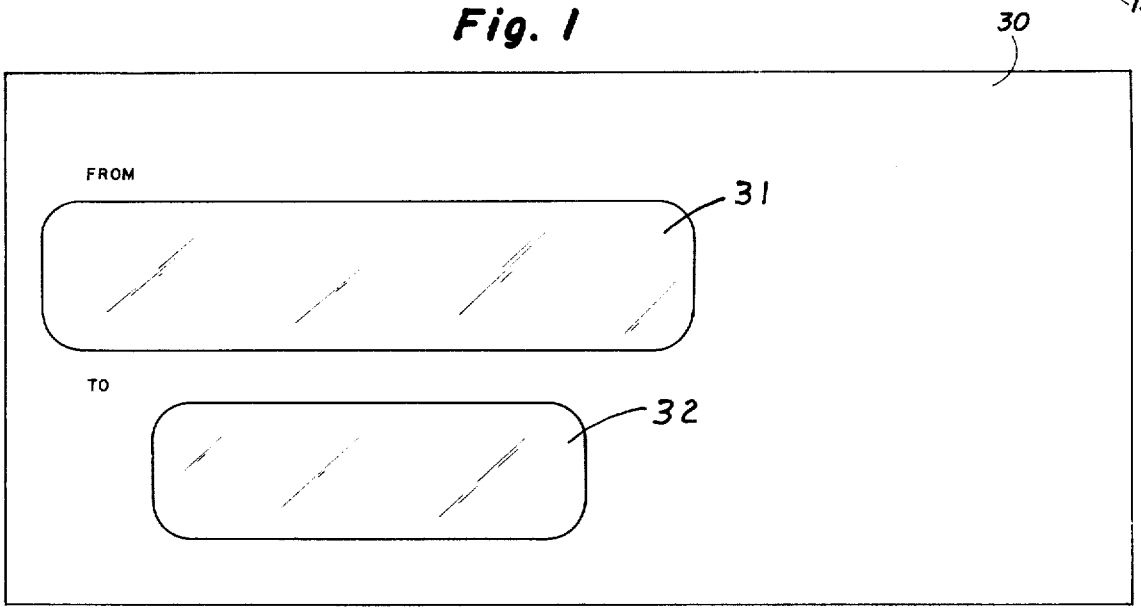
FIG. 2 is a plan view of a mailing envelope utilized with the present invention.
Figure 3:
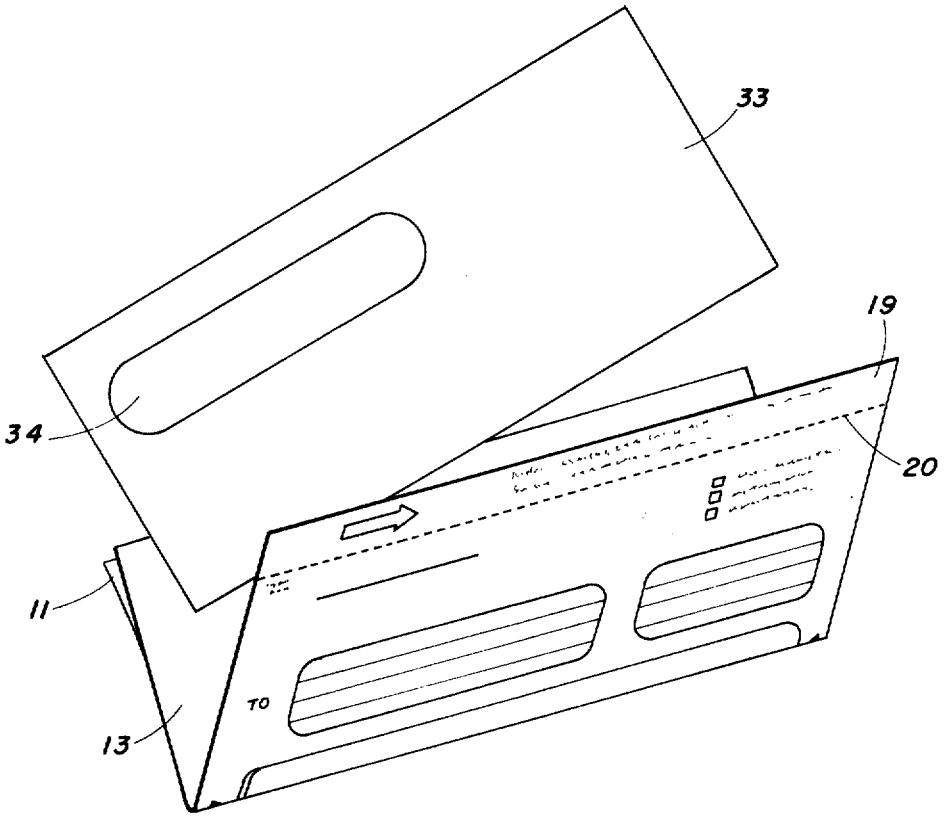
FIG. 3 is a perspective view of the form of FIG. 1 in a folded condition and with the middle sheet removed. The return envelope is shown as being positioned between the folded portions of the form.
Figure 4:
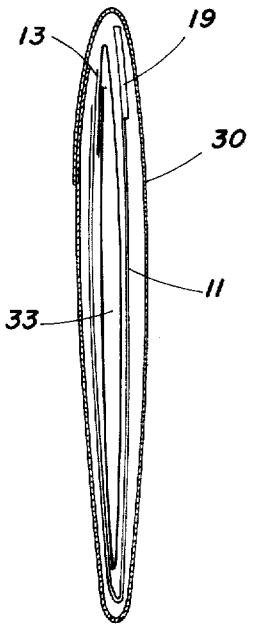
FIG. 4 is a cross sectional view of the envelope and folded form of FIG. 3 positioned within the mailing envelope of FIG. 2.

Sheets 11, 12 and 13 are parallel and each have a top stub portion 19 attached together with the middle sheet disposed between the top and bottom sheet. The middle sheet is removable from the top and bottom sheets subsequent to the information being written on the top sheet and transferred to the middle and the bottom sheet. After the message has been written into section 17 and the appropriate addresses have been placed in areas 14 and 16, the middle sheet 12 is removed from the form. Sheet 12 is kept for record purposes in the sender's files. The top and bottom sheets are then folded along a line defined by fold indicators 24 so as to position the bottom sheet 13 inward of the top sheet 11 as shown in FIG. 3 and so that the address of the sender and the address of the receiver appear on the same side of the fold. A return envelope 33 having a window 34 is then positioned inward of the top and bottom sheets which are in the folded condition. Folded sheets 11 and 13 along with return envelope 33 are then positioned in a larger mailing envelope 30 (FIG. 4) which has a pair of windows 31 and 32 (FIG. 2). The top and bottom sheet when in the folded condition have a folded length equal to the distance 25 between the top edge of the form and the first fold indicator 24. Mailing envelope 30 has an interior length approximately equal to distance 25 but not less than distance 25 so as to prevent excessive lengthwise shift of the top and bottom sheet and to prevent lengthwise movement of areas 14 and 16 which are in registry with windows 31 and 32. By stating that the distance 25 is approximately equal to the interior length of envelope 30 is meant that the form will not be able to shift upward or downward sufficiently so as to prevent visual observation through windows 31 and 32 of the names and addresses contained in areas 14 and 16 of sheet 11. Area 14 is provided with a horizontal line 15 below which the address of the sender may be positioned with the name of the sender being positioned above line 15. Thus, if the form is to be utilized by a company, then the company name and address may be printed below line 15 with the name of the individual sender being typed above line 15. The horizontal boundaries of stubs 19 are defined by the top edge of the form and tearable lines 20.

Figure 5:
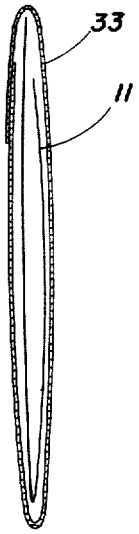
FIG. 5 is a cross sectional view of the top sheet of the form of FIG. 3 positioned within the envelope of FIG. 3.

After the receiver receives the envelope 30 (FIG. 4) with the folded top and bottom sheets and return envelope contained therein, the receiver will open and discard envelope 30. The receiver will then write his message or reply in section 18 on the top sheet with the message being automatically transferred to bottom sheet 13. The receiver then removes sheet 13 from the form and places the bottom sheet 13 in his files for storage purposes. The receiver then removes sheet 11 from stub portion 19 by tearing along line 20 and then refolds the sheet along fold indicators 24. The return envelope 33 has an interior length approximately equal to but not less than the folded length of sheet 11 after the sheet has been removed from stub 19. The distance from fold indicator 24 to the bottom edge of sheet 11 is greater than the distance from the fold indicator 24 to the new top edge of sheet 11 which was previously defined by perforated line 20. The folded length of sheet 11 after removal from stub 19 is therefore equal to the distance from fold indicator 24 to the bottom edge of sheet 11. Folded sheet 11 is then inserted into envelope 33 as shown in FIG. 5 with the sender's name and address which is positioned within area 14 being placed in registry with window 34. The folded length of sheet 11 prevents excessive lengthwise shift of the sheet and movement of area 14 with respect to window 33. It may be seen that due to dimension 25, sections 14 and 16 are automatically in registry with windows 31 and 32 whereas with sheet 11 removed from stub 19, the distance from indicator 24 to the bottom edge of sheet 11 automatically places area 14 in registry with window 34.

Figure 7:
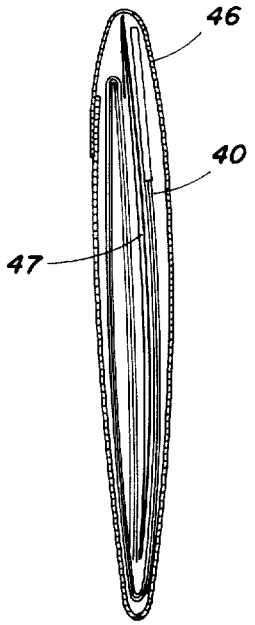
FIG. 7 is a cross sectional view of the form of FIG. 6 shown folded with a return envelope positioned within the folds of the form and with both the form and return envelope shown contained within a mailing envelope.
Figure 6:
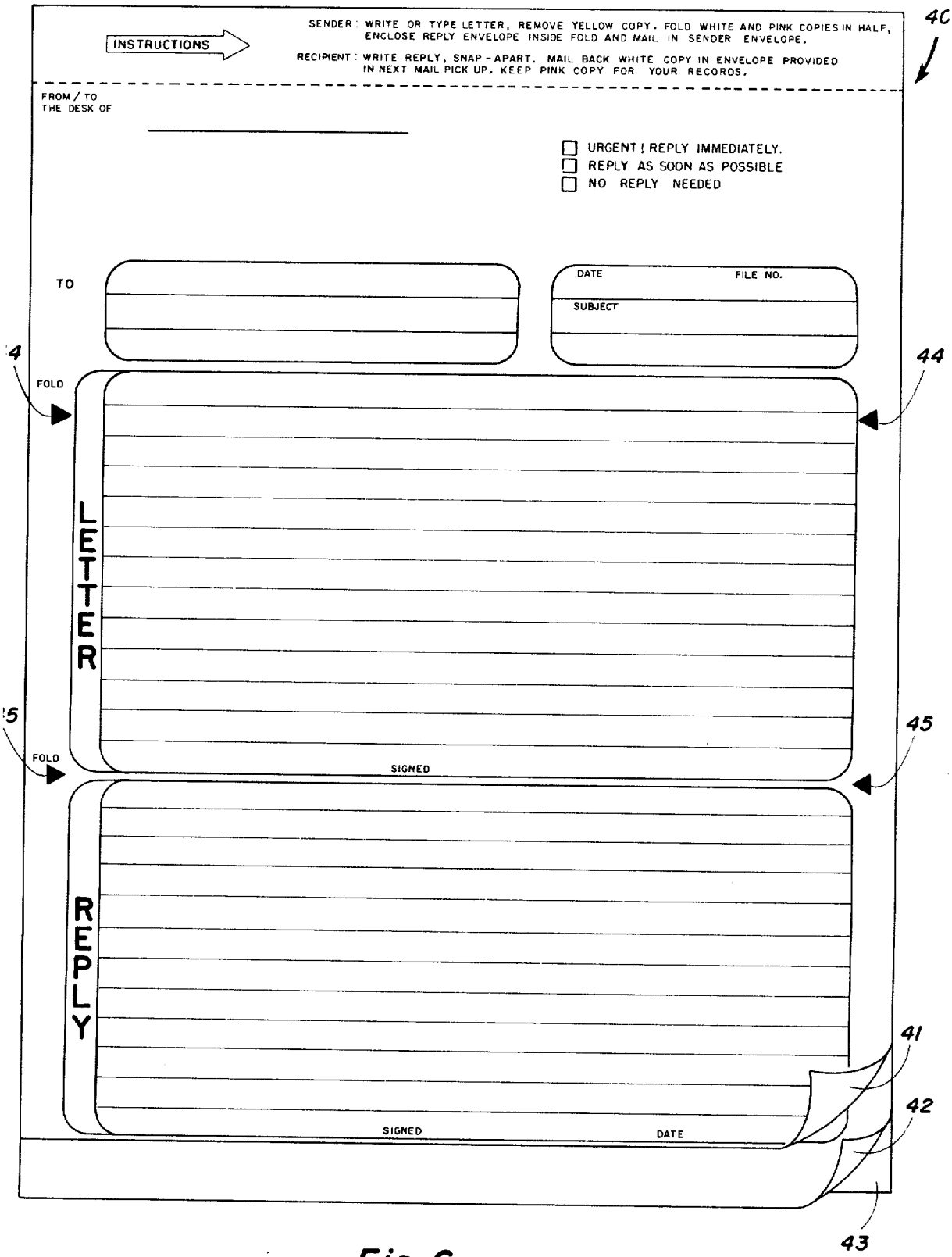
FIG. 6 is a plan view of an alternate embodiment of the form of FIG. 1.

In many cases, the message to be placed in areas 17 and 18 will be sufficiently long so as to require a longer form than that shown in FIG. 1. Therefore, an alternate embodiment of the form is shown in FIG. 6. Long form 40 contains all of the printed matter of form 10 and includes two different pairs of fold indicators 44 and 45 in lieu of only a single pair of fold indicators 24 for form 10. Form 40 includes a top sheet 41, a middle sheet 42 and a bottom sheet 43 which are joined at their top portions in a manner identical to form 10. That is, each sheet of form 40 is provided with a top stub portion separated from the remaining portion of the sheet by a perforated line. The stub portions may be secured together by means such as adhesives or other similar fastening means. The sheets of form 40 may have carbon paper disposed therebetween or alternatively the middle and bottom sheets may be made from carbonless imaging paper. The second pair of fold indicators 45 are locatd between the first fold indicators 44 and the bottom edge of sheet 41. Form 40 in the folded condition shown in FIG. 7 has the portion between the bottom edge and the second fold indicators 45 folded inwardly between the portion defined between fold indicators 44 and 45 and the portion defined by fold indicators 44 and the top edge of the form. The first pair of indicators 44 are spaced from the second pair of indicators 45 a distance greater than the distance between the first pair of indicators 44 and the tearable line. The distance from indicators 44 to indicators 45 is less than the distance from indicators 44 to the top edge of the form. The sender and receiver areas will be in registry with the pair of windows of envelope 46, identical to envelope 30, when the form is folded as shown in FIG. 7 with the return envelope 47, identical to envelope 33, being diposed inwardly of the top and bottom sheet. As described for the short form embodiment, the receiver will write his reply on the top sheet and then remove the bottom sheet for his files. The receiver will then remove the top sheet from the stub portion and refold along indicators 44 and 45 repositioning the folded top sheet within return envelope 47 which is provided with a window in registry with the addresser area of the top sheet in a manner similar to that described for the short form.

The return envelopes of both embodiments have an exterior width not greater than but approximately equal to the interior width of the larger mailing envelope. As a result, when the return envelope is positioned with the top and bottom sheet within the larger mailing envelope, the return envelope will not shift and will therefore prevent lateral movement of the sender area and receiver area with respect to the pair of windows of the mailing envelope.

A variety of different sizes may be utilized for the short and long form. In one embodiment, the short form had a top sheet with a length of 7⅜ inches, a middle sheet with a length of 8 inches and a bottom sheet with a length of 7⅞ inches. The length 26 of the stub portion was ¾ inches and is included in the above sheet lengths. The fold indicators were positioned approximately 3 15/16 inches from the top edge of the form. In an embodiment of the long form, the top sheet had a length of 10 11/16 inches, the middle sheet had a length of 11¼ inches and the bottom sheet had a length of 10 15/16 inches. The stub was ¾ inches long with the distance from the top edge to the first fold indicators being 3 15/16 inches. The distance from the first fold indicator to the second fold indicator was 3 15/32 inches.

Figure 8:
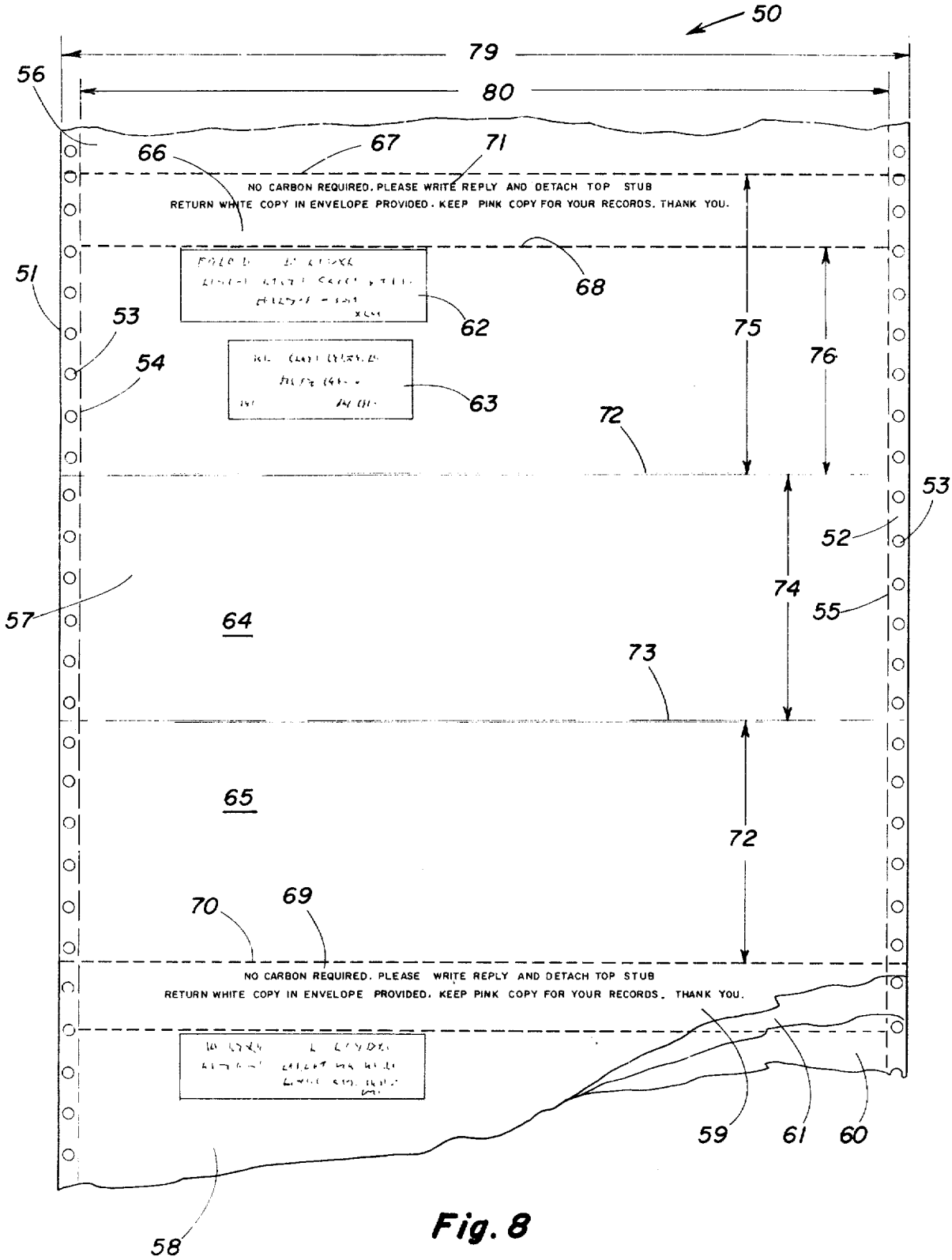
FIG. 8 is a plan view of the preferred embodiment of the present invention and shows a continuous mailing and return form.
Figure 9:
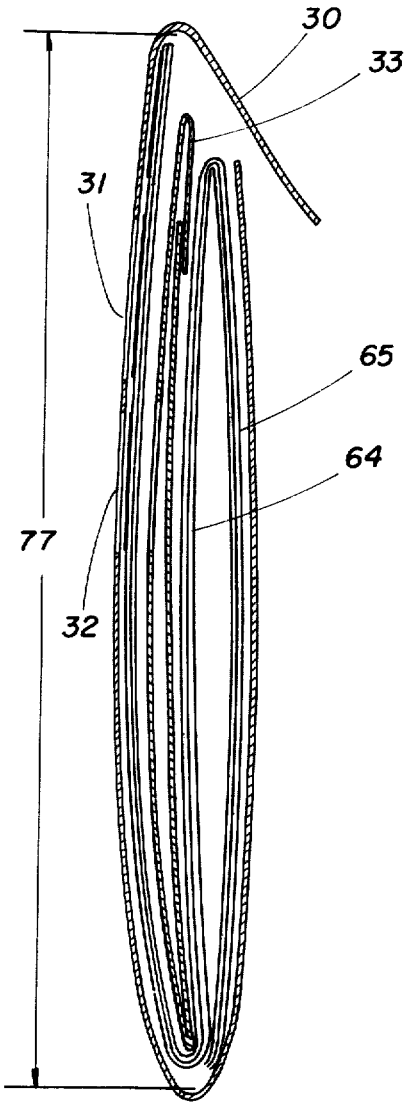
FIG. 9 is a cross sectional view of the return envelope shown in FIG. 3 along with one unit set of the continuous form of FIG. 8 positioned within the mailing envelope of FIG. 2.
Figure 10:
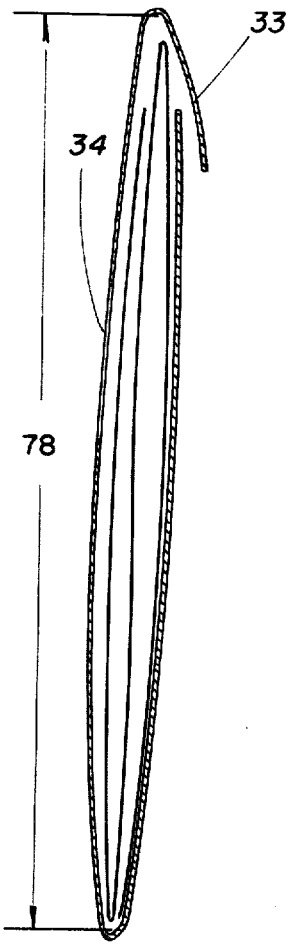
FIG. 10 is a cross sectional view of the top sheet of the unit set of FIG. 9 positioned within the return envelope.

In many cases, the sender will desire to rapidly send messages to many receivers. Automated print-out machines are available for use with continuous forms. FIGS. 8-10 show an embodiment of the present invention wherein a continuous form is utilized along with the previously described mailing envelope 30 and return envelope 33.

Continuous form 50 (FIG. 8) is provided at its opposite longitudinal edge portions 51 and 52 with apertures 53 for engagement with the drive means of an automated print-out machine. Portions 51 and 52 are separable from the main body of each sheet along perforated lines 54 and 55.

Continuous form 50 includes a plurality of unit sets 56, 57 and 58 joined together. Unit set 57 will now be described, it being understood that a similar description applies to unit sets 56 and 58 as well as the other unit sets of the continuous form 50 not shown in the drawing. Unit set 57 includes at least two sheets 59 and 60 of equal length. Additional sheets may be added as required. Means are provided, such as carbon paper 61, to transfer the image from sheet 59 to sheet 60. Carbon imaging paper, such as described previously for sheets 12 and 13, may be utilized for sheets 59 and 60 in lieu of carbon paper 61.

Sheets 59, 60 and 61 are connected together at the top portion of each sheet. The printed matter on sheet 59 may be identical with the printed matter on sheet 60. Thus, the following description of sheet 59 will apply equally to sheet 60. Area 62 is reserved for placing the name and address of the sender whereas area 63 located immediately beneath area 62 is reserved for the placing of the name and address of the receiver. The letter or message placed on the sheet by the sender may be positioned in area 64 beneath area 63 whereas any reply or message from the receiver may be placed in area 65 beneath area 64. In many cases, the present invention may be utilized for billing the receiver. In this particular instance, the details of the various charges of the bill would be placed in area 64 whereas the receiver could indicate in area 65 the amount of the money order or check returned to the sender.

Each sheet has a top stub portion 66. For example, unit set 57 includes a top stub portion 66 which is joined to unit set 56 along perforated line 67. Likewise, top stub portion 66 is joined along perforated line 68 to sheets 59 through 61 of unit set 57. An identical top stub portion 69 of unit set 58 is joined to each sheet of unit set 57 along perforated line 70. Various instructions 71 are located on the top stub portion of the top sheet of each unit set.

The names and addresses of the sender and receiver are first provided respectively in areas 62 and 63. The sender's message is then provided in area 64 and/or area 65. In the event that automated print-out machines are utilized with the continuous form, the information in areas 62 through 64 are generally printed or typed on the areas with the impressions then also being transferred to sheet 60. Unit set 57 is then separated along line 67 from unit set 56 and separated from unit set 58 along line 70. Unit set 57 is then placed into mailing envelope 30 along with return envelope 33 as shown in FIG. 9. In the embodiment of the continuous forms shown in FIG. 8, the distance 72 from perforated line 70 to fold 73 is equal to the distance 74 from fold 73 to fold 72. The distance 74 is less than the distance 75 from fold 72 to perforated line 67.

Unit set 57 may be folded accordian style such as shown in FIG. 9 with all three sheets 59 through 60 being located within envelope 30. When folding the form accordian style, the top surface of area 65 of sheet 59 faces inwardly being mutually opposed from the top surface of area 64 of sheet 59. Sender section 62 and receiver section 63 face outwardly to show respectively through windows 31 and 32 previously described.

Upon receipt of envelope 30, the receiver opens envelope 30, removes the contents and then discards envelope 30. In the event that a reply by the receiver is necessary, then the receiver writes his reply in area 65 (FIG. 8). Sheet 60 is then removed and placed in the receiver's files whereas sheet 61 is discarded. The top sheet 59 is then removed from the top stub portion 66 and inserted into envelope 33 with the sender's name and address located in section 62 automatically being in registry with window 34 of envelope 33. In the case where the message contained on the unit set is a bill from the sender to the receiver, thereby not requiring a written reply by the receiver, the receiver merely separates sheet 59 from top stub portion 66 and encloses sheet 59 along with his check or money order in envelope 33 to return to the sender.

Distance 75 is equal to or slightly less than the interior height 77 of envelope 30 preventing excessive up and down movement of the sender and receiver addresses with respect to windows 31 and 32. Likewise, distance 74 is equal to or slightly less than the interior height 78 of envelope 33 preventing excessive up and down movement of the sender's name and address with respect to window 34. In the event that edge portions 51 and 52 are not removed from the unit set prior to mailing to the receiver, then it is desirable for the overall width 79 (FIG. 8) to be slightly less than the interior widths of envelope 30 and 33 to prevent excessive lateral shift of section 62 and 63 relative to windows 31, 32 and 34. Likewise, if edge portions 51 and 52 are removed prior to mailing the unit set to the receiver, then distance 80 from perforated line 54 to perforated line 55 should be slightly less than the interior widths of envelopes 30 and 33 to prevent excessive lateral shift of section 62 and 63 relative to windows 31, 32 and 34. As previously described for the other embodiments of the invention, the sender and receiver sections provided on the form are located with respect to the top edge of the sheet and the folds in such a manner so as to be in automatic registry with the windows of envelopes 30 and 33.

Many variations are contemplated and included in the continuous form. For example, additional sheets may be added to the unit set. For example, by adding an additional sheet the sender may remove one of the sheets prior to mailing to the receiver allowing for the retention of a copy by the sender. In the embodiment shown in FIGS. 8 through 10, the actual distance of distances 72 and 74 was approximately 3 ½ inches, whereas distances 75 and 76 were respectively four inches and 3 ¼ inches. Likewise, it is to be understood that the unit set 57 may be produced as a separate entity in lieu of being incorporated into a continuous form.

Unit set 57 may be manually folded or may be folded by an automated folding machine. As mentioned, the unit set is folded defining a fold while positioning sheet 60 inward of sheet 59 to position the sender section 62 and receiver section 63 on the same side of the fold. Return envelope 33 is positioned inward of sheets 59 and 60 with window 34 being in registry with sender section 62 when the top stub portion 66 is removed from the unit set and sheet 59 is folded along the folds and inserted in envelope 33 as described.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A mailing device comprising:

a first and second parallel paper sheet each having a top stub portion attached together, said first sheet having a sender section and a receiver section, said second sheet being removable therefrom, said first and second sheet being folded thereby defining a fold and positioning said second sheet inward of said first sheet, and said sender section and said receiver section on the same side of the fold;

a return envelope having a first window in registry with said sender section when said stub portion of said first sheet is removed therefrom and said first sheet is removed from said second sheet and said first sheet is folded along said fold and inserted in said envelope; and, a sending envelope containing said first and second sheet in said folded condition and said return envelope enclosed in said sending envelope, said sending envelope having a second window in registry with said receiver section;

said first sheet having a top edge spaced a fixed distance from said first fold, said sending envelope having an interior length not less than said distance and approximately equal thereto preventing excessive lengthwise shift of said first sheet and movement of said receiver section with respect to said second window.

2. The mailing device of claim 1 wherein said sheets are the same length from the top edge thereof to the bottom thereof.

3. A mailing device comprising:

a packet originally including first and second parallel paper sheets, said first sheet and said second sheet each having a sender section and a receiver section, said first sheet being foldable positioning said second sheet inwardly of said first sheet and said sender section and said receiver section at a predetermined location with relation to said fold;

a return envelope positionable inwardly of said first sheet with said first and second sheet in a folded condition, said envelope having a first window in registry with said sender section when said second sheet is removed from said first sheet and with at least one of said sheets folded at said fold and inserted in said envelope;

a sending envelope for containing said first and second sheet in said folded condition and said return envelope positioned inwardly of said first sheet, said sending envelope having a second window in registry with said receiver section when said first sheet and said second sheet are in said folded condition and inserted in said sending envelope;

said first sheet having a top edge spaced a fixed distance from said fold, said sending envelope having an interior length not less than said distance and approximately equal thereto preventing excessive lengthwise shift of said first sheet and movement of said sender section and receiver section with respect to said second window.

4. The mailing device of claim 3 wherein:

said paper sheets each have a top stub portion attached together;

said first sheet when folded has said sender section and said receiver section on the same side of the fold; and, said first window is in registry with said sender section when said stub portion of said first sheet is removed therefrom.

5. The mailing device of claim 4 wherein said sheets are the same length from the top edge thereof to the bottom thereof.

6. The mailing device of claim 5 wherein said sheets have side stubs thereon which are perforated.

7. The mailing device of claim 5 wherein said sheets are connected at their top edges and bottoms to additional sheets having sender sections and receiver sections.

8. The mailing device of claim 6 wherein:

said sheets each have a width including said side stubs, said sending envelope has an interior width greater than said width of said sheets to allow insertion of said sheets into said sending envelope but not so great as to allow excessive lateral shift of said sender section and receiver section relative to said first window and said second window.

9. The mailing device of claim 6 wherein:

said sheets each have a width, said sending envelope has an interior width greater than said width of said sheets to allow insertion of said sheets into said sending envelope but not so great as to allow excessive lateral shift of said sender section and receiver section relative to said first window and said second window.

10. A mailing device comprising:

a packet originally including first and second parallel paper sheets, said first sheet and said second sheet each having a sender section and a receiver section, said first sheet being foldable positioning said sender section and said receiver section at a predetermined location with relation to the fold;

a return envelope positionable inwardly of said first sheet with said first sheet in a folded condition, said envelope having a first window in registry with said sender section when said second sheet is removed from said first sheet and with at least one of said sheets folded at said fold and inserted in said envelope;

a sending envelope for containing said first sheet in said folded condition and said return envelope positioned inwardly of said first sheet, said sending envelope having a second window in registry with said receiver section when said first sheet is in said folded condition and inserted in said sending envelope;

said first sheet having a top edge spaced a fixed distance from said fold, said sending envelope having an interior length not less than said distance and approximately equal thereto preventing excessive lengthwise shift of said first sheet and movement of said receiver section with respect to said second window.

11. A mailing device comprising:

a sheet having a sender section and a receiver section and being foldable along a fold positioning said sender section and said receiver section at a predetermined location with relation to said fold;

a return envelope positioned inwardly of said sheet with said sheet in a folded condition, said envelope having a first window in registry with said sender section when said sheet is folded along said fold and inserted in said envelope;

a sending envelope for containing said sheet in said folded condition and said return envelope positioned inwardly of said sheet, said sending envelope having a second window in registry with said receiver section when said sheet is folded along said fold and inserted in said sending envelope;

said sheet having a top edge spaced a fixed distance from said fold, said sending envelope having an interior length not less than said distance and approximately equal thereto preventing excessive lengthwise shift of said sheet and movement of said receiver section with respect to said second window.

12. A mailing device comprising:

a sheet having a first address section and a second address section and being foldable along a fold positioning said first address section and said second address section at a predetermined location with relation to said fold;

a return envelope positioned inwardly of said sheet with said sheet in a folded condition, said envelope having a first window in registry with said first address section when said sheet is folded along said fold and inserted in said envelope;

a sending envelope for containing said sheet in said folded condition and said return envelope positioned inwardly of said sheet, said sending envelope having a second window in registry with said second address section when said sheet is folded along said fold and inserted in said sending envelope;

said sheet having a top edge spaced a fixed distance from said fold, said sending envelope having an interior length not less than said distance and approximately equal thereto preventing excessive lengthwise shift of said sheet and movement of said second address section with respect to said second window.

* * * * *